United States Patent [19]

Lee et al.

[11] 4,131,462

[45] Dec. 26, 1978

[54] ELEMENT FOR THERMOPLASTIC RECORDING

[75] Inventors: Tzuo-Chang Lee; Jacob W. Lin, both of Bloomington, Minn.

[73] Assignee: Honeywell Inc., Minneapolis, Minn.

[21] Appl. No.: 658,324

[22] Filed: Feb. 17, 1976

[51] Int. Cl.[2] ..... G03G 5/10; G03G 13/22; B41M 5/20

[52] U.S. Cl. ..... 96/1.5 R; 346/151; 96/1.1; 365/112; 365/47; 358/129

[58] Field of Search ..... 96/1.1, 1.5, 27 H; 340/173 TP; 346/74 TP, 151; 178/6.6 TP; 350/3.5

[56] References Cited

U.S. PATENT DOCUMENTS

| | | | |
|---|---|---|---|
| 3,560,205 | 2/1971 | Urbach | 96/1.1 |
| 3,615,388 | 10/1971 | Gundlach | 96/1.5 |
| 3,719,483 | 3/1973 | Bean | 96/1.1 |
| 3,834,809 | 9/1974 | Yoshizawa et al. | 96/1.5 |
| 3,861,914 | 1/1975 | Gange | 96/1.1 |
| 3,953,207 | 4/1976 | Horgan | 96/1.5 |
| 3,997,238 | 12/1976 | Oride et al. | 96/1.1 |

*Primary Examiner*—Roland E. Martin, Jr.
*Assistant Examiner*—John L. Goodrow
*Attorney, Agent, or Firm*—Omund R. Dahle

[57] ABSTRACT

This invention pertains to an improved thermoplastic holographic recording medium having an added layer between the thermoplastic layer and the photoconductor layer. The added layer is electrically insulating at temperatures used for thermal development to prevent decaying charge contrast during hologram development.

15 Claims, 7 Drawing Figures

ELEMENT FOR THERMOPLASTIC RECORDING

BACKGROUND AND SUMMARY OF THE INVENTION

Thermoplastic-photoconductor holographic recording medium has generally been in the form of several transparent layers over a transparent substrate. Thus a substrate such as nesa glass or a flexible substrate such as Mylar is first coated thereon an optically transparent electrically conductive layer, then a photoconductor layer, and finally a thermoplastic layer. Previous thermoplastic holographic recording media suffer the problem of decaying charge contrast at the interface of the photoconductive and the thermoplastic layer during hologram develpment, resulting in low diffraction efficiency or in worse cases no deformation at all.

The charge contrast created by the holographic light pattern through the action of the photoconductor resides at the interface of the thermoplastic layer and the photoconductive layer. During thermal development the charge contrast tends to diminish due to increased electrical conductivity of the thermoplastic layer. As a result, the driving force for the surface deformation is weakened, thereby the deformation is much less than it could be had the charge contrast maintained intact. There exists a large electrical potential difference between the bright fringe and the dark fringe at the interface and this potential difference has a tendency to diminish the charge contrast. At temperatures below the softening temperature of the thermoplastic, however, the electrical conductivity is not high enough to wipe out the charge contrast. For example, with a polyvinyl carbazole (PVK) layer as the photoconductive layer, the electron mobility is sufficiently low at temperatures below 100° C to prevent charge smearing, but with the thermoplastic layer having a softening temperature of say 50° C, the charge contrast can be wiped out when the softening temperature is reached for a sufficiently long time.

In this invention we introduce a new layer between the thermoplastic layer and the photoconductive layer with the following properties: (a) It is non-photoconductive at the wavelength of the holographic recording but is photoconductive at a different wavelength. (b) It is electrically insulating at temperatures used for thermal development, that is, extremely low surface conductivity at the development temperature. The charge contrast created by the holographic exposure will, therefore, reside at the interface of this new layer and the photoconductive layer and during thermal development the charge contrast will remain intact. We can thus have a large driving force for deformation and achieve controllable and appreciable deformation.

After the thermal development, charges will reside across this new layer and they can be removed by using a wavelength to which this new layer is sensitive. As an example of fabricating such a device, a trinitrofluorenone (TNF) doped PVK layer is first coated on, say, indium oxide on glass, and then a special solvent such as xylene is used to leach out an appropriate amount of TNF from the surface of the doped PVK. This procedure generates the new layer mentioned in this invention because pure PVK (PVK stripped TNF) is photoconductive only at ultraviolet (UV) wavelengths and pure PVK is also electrically insulating at temperatures up to 180° C. Advantages of our present invention are: (a) the hologram diffraction efficiency ($\eta$) can be higher, (b) the dynamic range of $\eta$ vs. heat energy is greatly increased while in prior art $\eta$ is critically dependent on heat energy, (c) thermoplastic with relatively high electrical conductivity can be used.

DETAILED DESCRIPTION OF THE PREFERRED EMBODIMENTS

Figure 1:
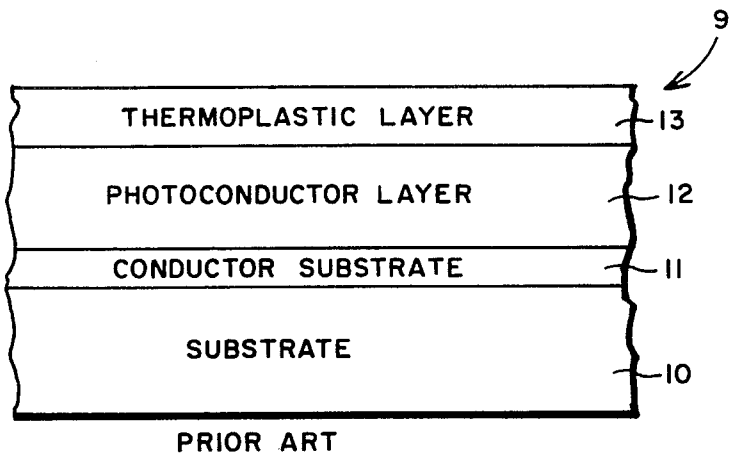
PRIOR ART FIG. 1
FIGS. 1 and 1*a* are sectional views of prior art thermoplastic-thermoconductive holographic recording medium construction.

The prior art thermoplastic-photoconductive holographic recording medium 9, such as is shown in FIG. 1, has a transparent conductive substrate 11, usually a thin film of metal such as gold, over a transparent base 10 such as nesa glass or a flexible Mylar tape. Coating the conductive substrate is a photoconductive layer 12 and then a thermoplastic layer 13. Recording on thermoplastic-photoconductive holographic recording medium is described in such articles as "An Experimental Read-Write Holographic Memory", by Stewart, Mezrich, Cosentins, Nagle, Wendt, and Lahmar, RCA Review, 34, 3 (March, 1973). The recording process includes the steps of electrically charging the medium, exposing the medium with the information to be stored, recharging and heating to allow the thermoplastic to deform.

Figure 1A:
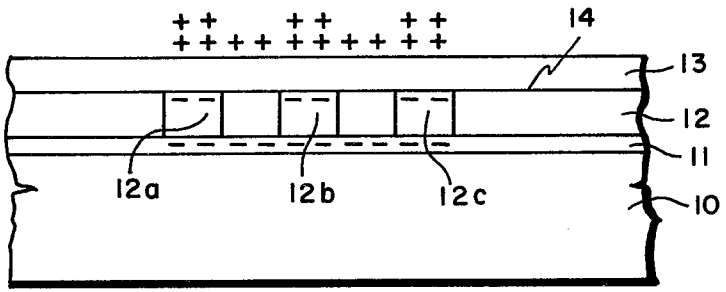
PRIOR ART FIG. 1a

In operation, i.e. in recording on the holographic recording medium, when the photoconductive layer 12 is selectively illuminated by a projected light pattern, the illuminated photoconductor sections 12*a*, 12*b*, and 12*c*, in FIG. 1*a*, become conductive allowing electrical charges to move adjacent the photoconductor-thermoplastic interface 14. During the subsequent hologram developing step, when the medium is heated to the softening temperature of the thermoplastic, a problem exists in that the charge contrast tends to decay or diminish due to increased electrical conductivity of the thermoplastic layer 13 at that temperature and the recording is not as successful as intended.

Figure 2:
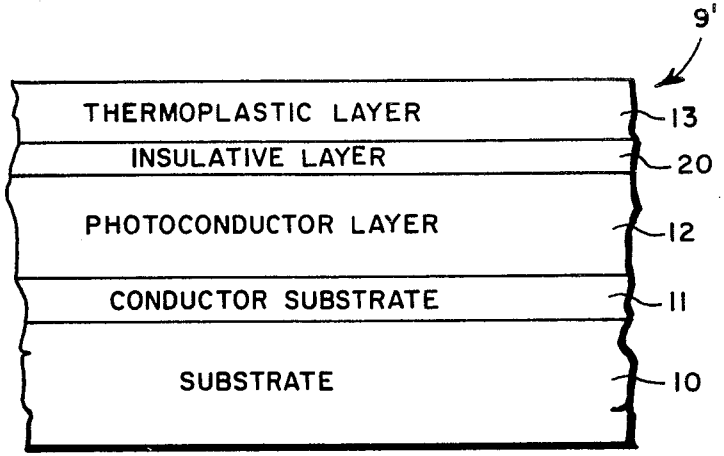
FIGS. 2 and 2*a* are sectional views of an improved thermoplastic-photoconductive holographic recording medium construction according to the invention.
Figure 2A:
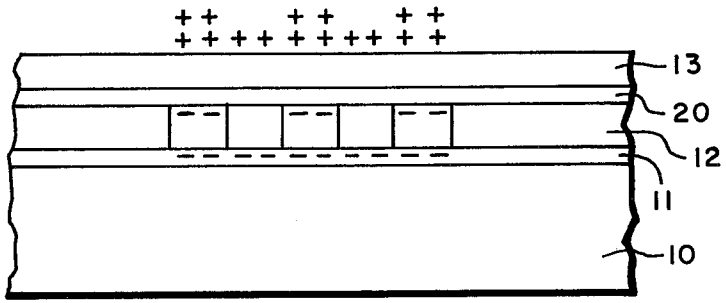

In the present invention shown in FIGS. 2 and 2*a*, the process of preparing the medium is changed from that of the prior art to introduce a new additional layer 20 between the photoconductive layer 12 and the thermoplastic layer 13 of the holographic recording medium 9'. The additional layer 20 is also photoconductive, but not at the wavelengths used for the holographic recording. If the photoconductive layer 12 coated onto the conductive layer is TNF doped PVK, then the new additional layer can be prepared from the surface portion of the photoconductive layer to provide two layers having differing characteristics. A special solvent, such as xylene, which can strip the TNF from, but which does not attack PVK, is applied to the surface of the photoconductive layer to leach out TNF dopant from the surface portion of the doped PVK. This procedure strips the PVK of some or all of the TNF and produces the new layer 20. Pure PVK is electrically insulating at temperatures up to 180° C. PVK doped with TNF (layer 12) is photoconductive to UV and visible light. The surface layer 20 of pure PVK is no longer photoconductive at visible light wavelengths as is layer 12, the photoconductivity spectrum of layer 20 having been shifted and occuring only in the ultraviolet wavelengths.

Referring to FIG. 2*a*, which shows representative charges during recording, it is seen that the charge contrast created by the holographic exposure resides at the interface of photoconductive layer 12 and the new insulative layer 20 and not at the thermoplastic interface. Thermal development at about 50° can now take place and the charge contrast remains intact.

In one device fabrication experiment, the samples were of a glass substrate with a transparent InO conductive layer. The samples were dip coated to obtain a layer of TNF doped PVK about 1.6 microns thick. Subsequently, these samples were dipped into a solution of xylene/ethanol 50/50 for a sufficient length of time to leach out the TNF from the surface area and form the surface layer of substantially pure PVK about 0.2 microns. A layer of copolymer thermoplastic about 1.8 microns thick was then coated over the new layer. After each layer was coated, the samples were baked or heat treated in a vacuum oven at 70° C for an hour.

To make a comparison, samples were fabricated respectively corresponding to the prior art shown in FIG. 1 and the new configuration as shown in FIG. 2. Other samples were prepared to provide a study of the diffraction efficiency as a function of leaching time.

All samples were evaluated under identical conditions. Briefly, the samples were first charged with a 5KV corona wire, then were exposed to the interference of two collimated 6328Å laser beams incident at the same angle from opposite sides of the normal to thermoplastic film. The energy of exposure was $7.6 \times 10^2 \mu Jcm^{-2}$ and the angle between signal and reference beams was 11.2°, i.e., a spatial frequency of 308 lines $mm^{-1}$. An appropriate amount of heat was applied to the sample by passing current through the transparent conductor layer 11 to soften the thermoplastic and complete the recording. A metallic grid was placed close to the thermoplastic film between the corona wire and the film to provide more precise control of the surface potential and thus the charge density on the thermoplastic.

Figure 3:
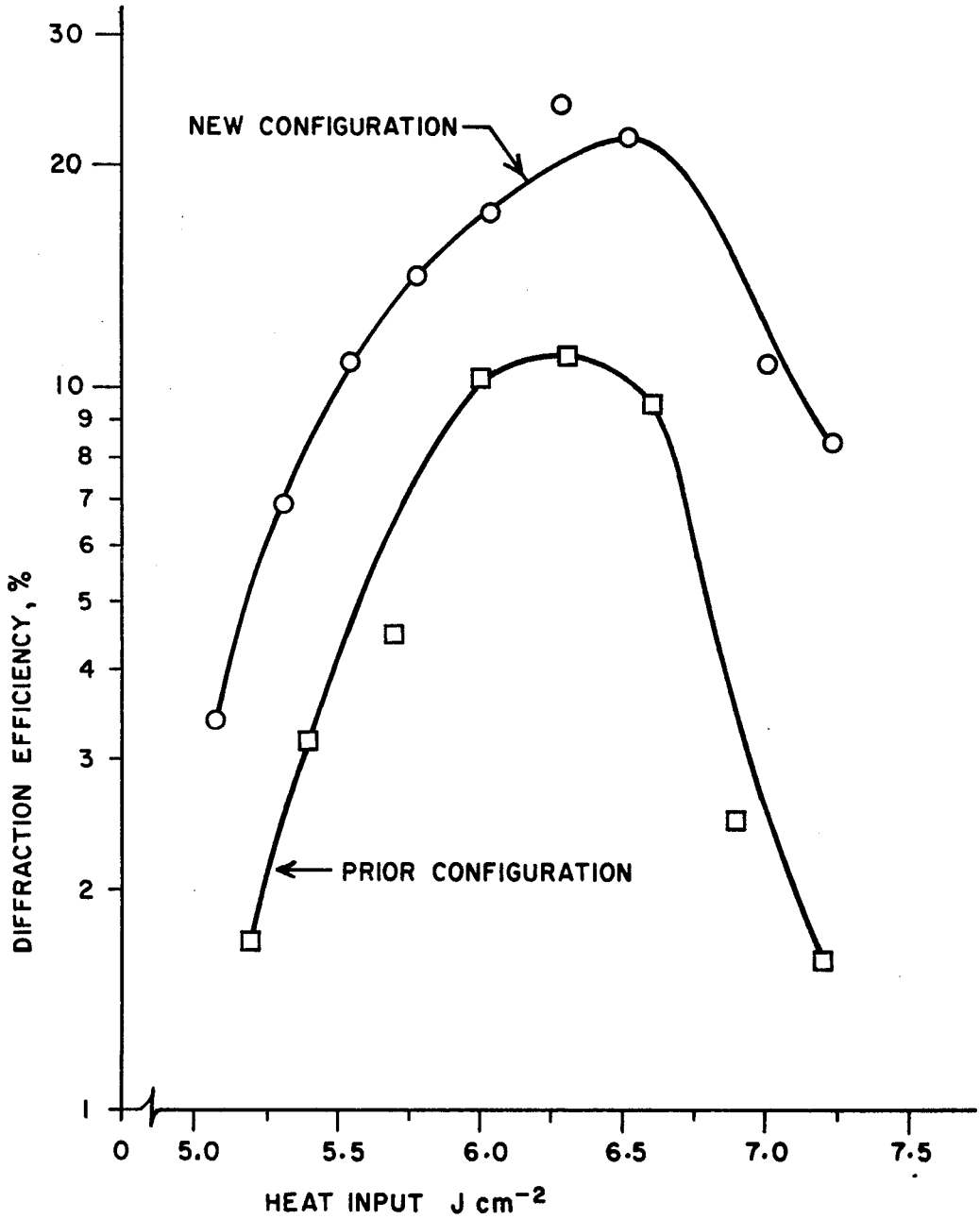
FIG. 3 plots diffraction efficiency vs. develop heat energy.
Figure 4:
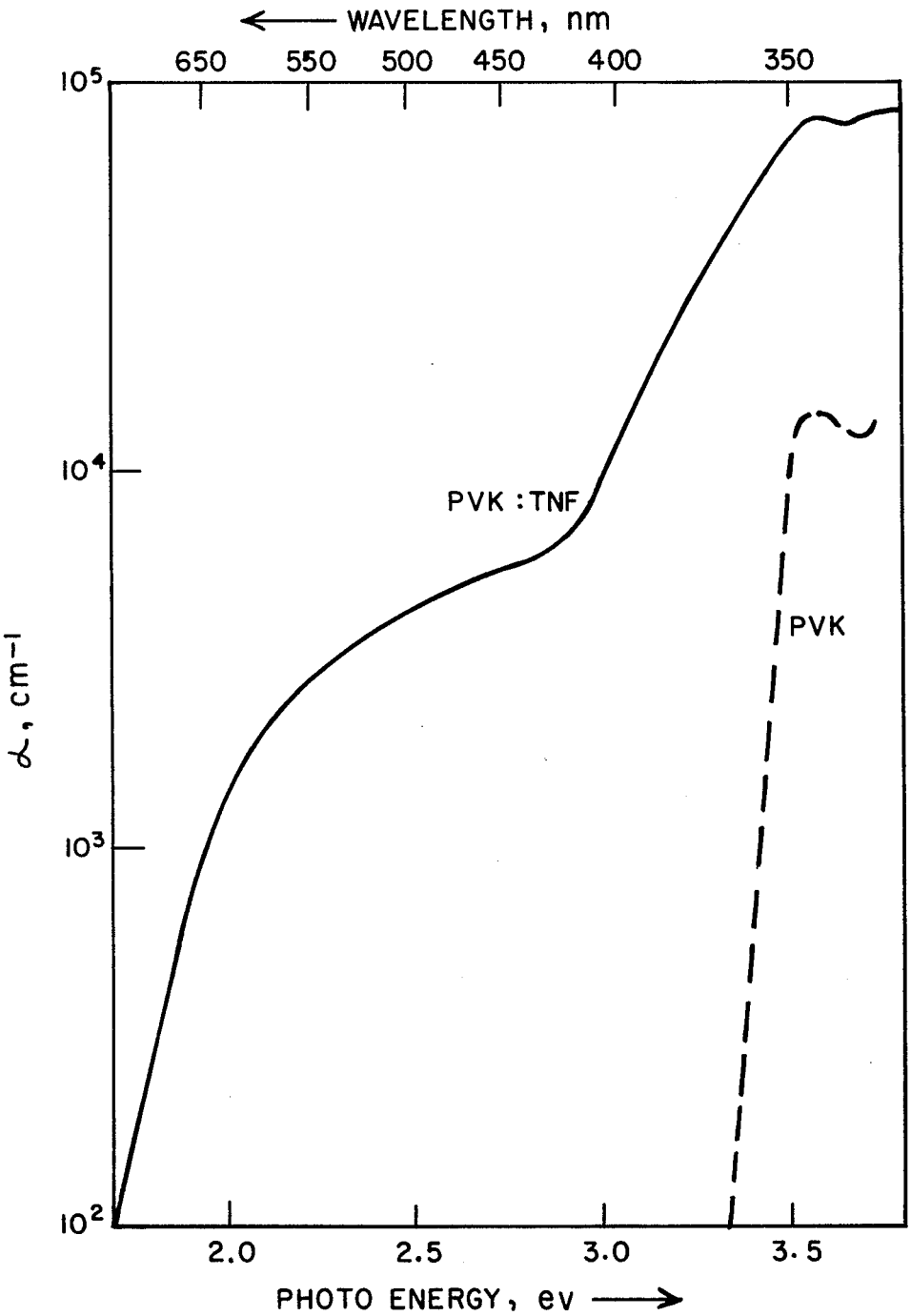
FIG. 4 shows a spectra response of TNF doped PVK and pure PVK.

FIG. 3, a semi-log presentation, shows a typical result of diffraction efficiency versus develop energy (heat input, $J/cm^2$) for a copolymer thermoplastic on the new recording medium and prior art recording medium. The electrostatic field on the thermoplastic layers was about $130 \mu m^{-1}$. The optimum efficiency for the new medium was around 25% at heat input of 6.3 J $cm^{-2}$.

Figure 5:
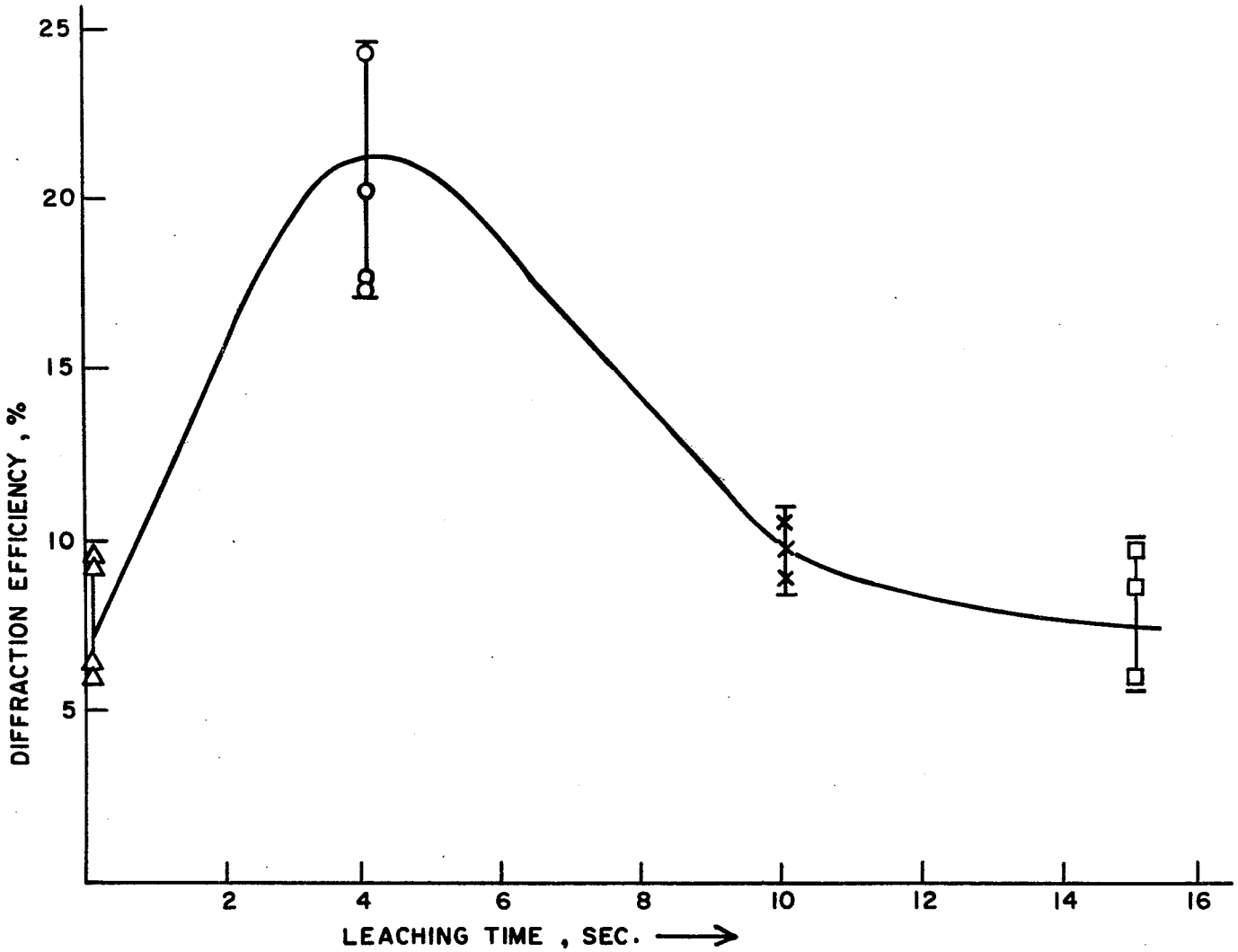
FIG. 5 plots diffraction efficiency vs. leaching time.

An interesting dependence of the diffraction efficiency curve shape on the duration of leaching time was observed. In one experiment a 50/50 mixture of xylene and ethanol solution was used as the leaching agent. The curve in FIG. 5 was made from the results of four sample sets leached for 0, 4, 10, and 15 seconds. All four samples were fabricated in a similar manner and evaluated under identical conditions. The error bars on the figure indicates the variation of diffraction efficiencies from several samples treated identically. With the particular test condition used in this evaluation, the peak of the curve occurs at a leaching time of four seconds. A decrease in diffraction efficiency at longer leaching time is expected due to the reduced TNF concentration in the bulk PVK film.

The embodiments of the invention in which an exclusive property or right is claimed are defined as follows:

1. An improved thermoplastic holographic recording medium comprising in sequence:

a substrate coated with an electrically conductive layer;

a photoconductive layer on the electrically conductive layer;

an insulating layer over the photoconductive layer which insulating layer is photosensitive at a wavelength other than the recording wavelength; and a thermoplastic layer over the insulating layer.

2. The invention according to claim 1 in which the photoconductive layer is TNF doped polyvinyl carbazole.

3. The invention according to claim 2 in which the insulating layer is a substantially pure layer of polyvinyl carbazole.

4. The invention according to claim 3 in which the layer of polyvinyl carbazole is made at the surface of the photoconductive layer by chemical leaching the surface of the doped photoconductive layer.

5. The invention according to claim 1 in which the substrate is a flexible substrate.

6. An improved thermoplastic recording medium for recording at a predetermined wavelength range comprising in sequence:

an electrically conductive layer on a substrate;

a photoconductive layer, with a first wavelength range of photo response within said predetermined wavelength range, coated on said conductive layer;

a further insulative layer on said photoconductive layer which further layer is photosensitive with a second wavelength range of photo response at a wavelength other than said recording predetermined wavelength range; and a thermoplastic layer coated over said further layer.

7. The invention according to claim 6 in which the photoconductive layer is doped, and further in which said insulating layer is of the same material as said photoconductive layer but with a much lower doping concentration so that it is not photoresponsive in said first wavelength range.

8. The invention according to claim 6 in which the photoconductor layer comprises TNF doped polyvinyl carbazole and in which the further layer is polyvinyl carbazole having a lesser concentration of TNF.

9. The invention according to claim 8 in which the second polyvinyl carbazole layer is formed by chemical leaching the surface of the first layer to remove the dopant concentration near the surface of the photoconductive layer thereby providing an insulating layer.

10. The invention according to claim 6 in which the substrate is a flexible substrate.

11. A process for providing an improved thermoplastic holographic recording medium comprising the steps of:

coating an electrically conductive layer on a substrate;

providing a doped photoconductive layer on the conductive layer;

providing a layer which is photoconductive at a wavelength other than the recording wavelength and which is otherwise an electrical insulator over the photoconductive layer; and coating with thermoplastic the insulator layer.

12. The process according to claim 11 in which the conductor is indium oxide.

13. The process according to claim 11 in which the photoconductive layer is TNF doped polyvinyl carbazole.

14. The process according to claim 11 in which the step of providing an insulator layer comprises chemical leaching the surface of the doped photoconductive layer to reduce the doping concentration near the surface of the photoconductive layer.

15. A process for providing an improved thermoplastic holographic recording medium comprising the steps of:

coating a conductor on a substrate;

coating a TNF doped polyvinyl carbazole (PVK) photoconductive layer on the conductive layer;

providing a further layer which is photoconductive at a wavelength other than the recording wavelength and which is otherwise an electrical insulator over the photoconductor by leaching the surface of the PVK with xylene/ethanol to reduce the TNF dopant concentration near the surface of the photoconductor; and coating with thermoplastic the further layer.

* * * * *